US006088878A

United States Patent [19]

Antonucci et al.

[11] Patent Number: 6,088,878

[45] Date of Patent: Jul. 18, 2000

[54] HEIGHT ADJUSTABLE AUTOMOTIVE DECK LID BUMPER

[75] Inventors: Jeffrey L. Antonucci, Worcester, United Kingdom; Thomas Weuthen, Erkelent, Germany

[73] Assignee: Southco, Inc., Concordville, Pa.

[21] Appl. No.: 09/082,994

[22] Filed: May 22, 1998

[51] Int. Cl.[7] ..... E05F 5/06

[52] U.S. Cl. ..... 16/86 A; 296/207; 24/297; 24/585; 411/550

[58] Field of Search ..... 296/707; 16/86 A, 16/86 R, 82; 411/417, 418, 437, 550, 553, 508–510; 24/297, 453, 585, 597

[56] References Cited

U.S. PATENT DOCUMENTS

| | | | |
|---|---|---|---|
| 2,730,154 | 1/1956 | Aspey | 411/418 |
| 3,274,638 | 9/1966 | Bien | 16/86 A |
| 3,557,654 | 1/1971 | Weidner | 411/396 |
| 4,357,040 | 11/1982 | Tomioka et al. . | |
| 4,653,968 | 3/1987 | Rapata et al. . | |
| 4,867,725 | 9/1989 | Smith | 411/510 |
| 4,924,549 | 5/1990 | Morel et al. . | |
| 4,936,621 | 6/1990 | Shimoda et al. . | |
| 5,000,637 | 3/1991 | Adams | 411/510 |
| 5,314,280 | 5/1994 | Gagliardi et al. . | |
| 5,421,124 | 6/1995 | Zuccaro . | |
| 5,482,348 | 1/1996 | Mass et al. . | |
| 5,549,351 | 8/1996 | Park . | |
| 5,682,667 | 11/1997 | Flagg . | |

FOREIGN PATENT DOCUMENTS

| | | | |
|---|---|---|---|
| 115671 | 8/1984 | European Pat. Off. | 411/437 |
| 611868 | 8/1994 | European Pat. Off. | 16/86 A |
| 1155930 | 5/1958 | France | 411/417 |
| 2705308 | 11/1994 | France | 296/207 |

OTHER PUBLICATIONS

Volkswagon Bumper with outwardly expanding stud with ridges caused by cammed/screw mechanism.
Opel drawings, pp. 1–4.

*Primary Examiner*—Flemming Saether
*Attorney, Agent, or Firm*—Paul & Paul

[57] ABSTRACT

A deck lid bumper having a stud with a head and a shaft, the head adapted to bump against the deck upon closure of the deck against the bumper, the receptacle adapted to receive the shaft of the stud, the receptacle having means to secure the receptacle in a frame. A frictional surface is provided between the shaft of the stud and the receptacle sufficient to support the stud in a desired position within the receptacle and a lock is provided to lock the shaft portion of the stud into the receptacle by rotating the head of the stud with respect to the receptacle.

12 Claims, 15 Drawing Sheets

HEIGHT ADJUSTABLE AUTOMOTIVE DECK LID BUMPER

BACKGROUND OF THE INVENTION

This invention relates to the means and method that automotive deck lids are fitted to the frame of automobiles such that proper alignment of the deck lid with respect to the automotive panels is achieved. More particularly, the present invention relates to an automotive deck lid bumper assembly that adjustably engages the deck lid of an automobile as it is brought down into a locked position, such that the deck lid mates flush with the surrounding automobile body panels. Typically, at least two deck lid bumpers are provided on two sides of a door, trunk, hatch, engine compartment lids, or the like to align the lid with the adjacent body panels, for example, to align an engine compartment lid with its adjacent automobile fenders.

When mounting automotive deck lids, including trunk lids, hood lids, doors, hatches, and the like, it has been difficult and time consuming to adjust the traditionally screw mounted bumpers to adjust the right height position for the deck lid to be flush with surrounding body panels and for the deck lid latch properly engage. To accomplish proper alignment, prior to the present invention, a bumper must be mounted, the hood must be closed, a reading of how far out of alignment the deck lid is taken, the hood must be opened, the bumper must be adjusted, and the hood must then be closed again to double check. This process may be required to be repeated several times to achieve proper alignment of the deck lid with respect to the other automotive panels.

One form of prior art for such bumpers includes an aperture formed in the frame of the automobile beneath the deck lid which includes a helical thread. This rubber bumper having a stud portion and a head portion also contains a mating helical thread about the shaft portion of the bumper. The bumper is rotated into the aperture by a sufficient number of revolutions so that the head portion of the bumper is lowered (or raised) to a desired alignment position such that the deck lid is flush with its adjacent body panels. A major drawback to this particular design is that, after numerous closing of the hood, heat, vibration, shock and the like can cause the threaded shaft portion of the bumper to loosen due to the rubber threads stretching, either permanently or temporarily, thus causing the panels to be no longer aligned. This type of device is generally shown in the prior art in U.S. Pat. No. 4,653,968. Numerous means for preventing rotation have been devised, including, for example, detent means as described in the above patent, or by deformation of the threads. Adjustment for these general types of devices, as described above, is exceedingly difficult.

An additional device in the prior art can be seen in U.S. Pat. No. 4,924,549. Here, in the main embodiment, a automobile hood or trunk lid is lowered into place. The hood is raised and a tool is inserted into a recess in the head of its stud and rotated ninety degrees. A clamping rod uses a camming action to deflect an inner member which holds the stud in place.

Finally, another device that has been used to help overcome the above difficulties in alignment has been provided in a bumper in which a stud is frictionally held in place within a receptacle by grooves in the stud that mate with grooves in the receptacle. The receptacle is mounted to a frame over which the deck is seated. The deck is lowered onto the stud which retracts into the receptacle until the proper height of the deck with respect to the frame is achieved. The deck is then raised away from the bumper and a screw is rotated in the stud such that the stud expands outwardly to increase the friction of the stud within the receptacle to securely hold the stud in place. Problems here include the requirement for a tool to secure the stud in position within the receptacle and no clear "locking position" where it can easily be visually observed whether the stud is locked in position.

The present invention provides a new and improved means and method to provide an adjustable bumper that quickly and accurately provides for precise spacing of the deck lid with respect to the adjacent body panels such that a smooth, integrated appearance is achieved and any latches operate effectively.

SUMMARY OF THE INVENTION

The present invention is directed to an automotive deck lid bumper with snap-in receptacle that is installed in the car frame with the bumper stud already in the receptacle in an extended position. By closing the hood against the assembly, either slowly or with a gentle slam, the hood pushes the bumper stud into its receptacle with a ratcheting action as the hood is closed against it. The hood is then opened and the bumper shaft is twisted approximately ninety degrees (one quarter turn) to lock it into a fixed position.

The automotive deck lid bumper of the present invention comprises a stud with a head and a shaft, the head adapted to bump against the deck upon closure of the deck against the bumper, the receptacle adapted to receive the shaft of the stud, the receptacle having means to secure the receptacle in a frame. A frictional surface is provided between the shaft of the stud and the receptacle sufficient to support the stud in a desired position within the receptacle and a lock is provided to lock the shaft portion of the stud into the receptacle by rotating the head of the stud with respect to the receptacle less than one full revolution.

It is therefore an object of the present invention to provide a new and improved automotive deck lid bumper.

It is a further object of the present invention to provide a new and improved automotive deck lid bumper that is simple and easy to adjust.

It is a further object of the present invention to provide a new and improved automotive deck lid bumper that may be snapped into position on a frame, such as an automobile frame, by hand pressure, without using any tools.

It is a still further object of the present invention to provide a new and improved automotive deck lid bumper that provides an automotive deck lid bumper that is simple and easy to adjust, that, once adjusted, may be locked in place such that the deck lid will not become misadjusted with respect to adjacent panels.

It is a still further object of the present invention to provide a new and improved automotive deck lid bumper that provides an automotive deck lid bumper that is simple and easy to adjust, that, once adjusted, may be locked in place such that the deck lid will not become misadjusted with respect to adjacent panels, that has an lock-in means that firmly secures the bumper in position such that slippage is avoided.

It is a still further object of the present invention to provide a new and improved automotive deck lid bumper that provides an automotive deck lid bumper that is simple and easy to adjust, that, once adjusted, may be locked in place such that the deck lid will not become misadjusted with respect to adjacent panels that has an optional lock-in means that firmly secures the bumper in position such that slippage is avoided that also generates an audible signal when the stud is properly locked into position in the receptacle.

It is a still further object of the present invention to provide a new and improved automotive deck lid bumper that provides an automotive deck lid bumper that is simple and easy to adjust, that, once adjusted, may be locked in place such that the deck lid will not become misadjusted with respect to adjacent panels that is simple in construction and contains a minimal number of parts.

It is a another object of the present invention to provide a new and improved automotive deck lid bumper that provides an automotive deck lid bumper that is simple and easy to adjust, that, once adjusted, may be locked in place such that the deck lid will not become misadjusted with respect to adjacent panels that is simple in construction and contains a minimal number of parts, all of which may be manufactured inexpensively.

Other objects and advantages of the present invention will become apparent from the following description taken in conjunction with the accompanying drawings.

DESCRIPTION OF THE PREFERRED EMBODIMENT

Figure 2:
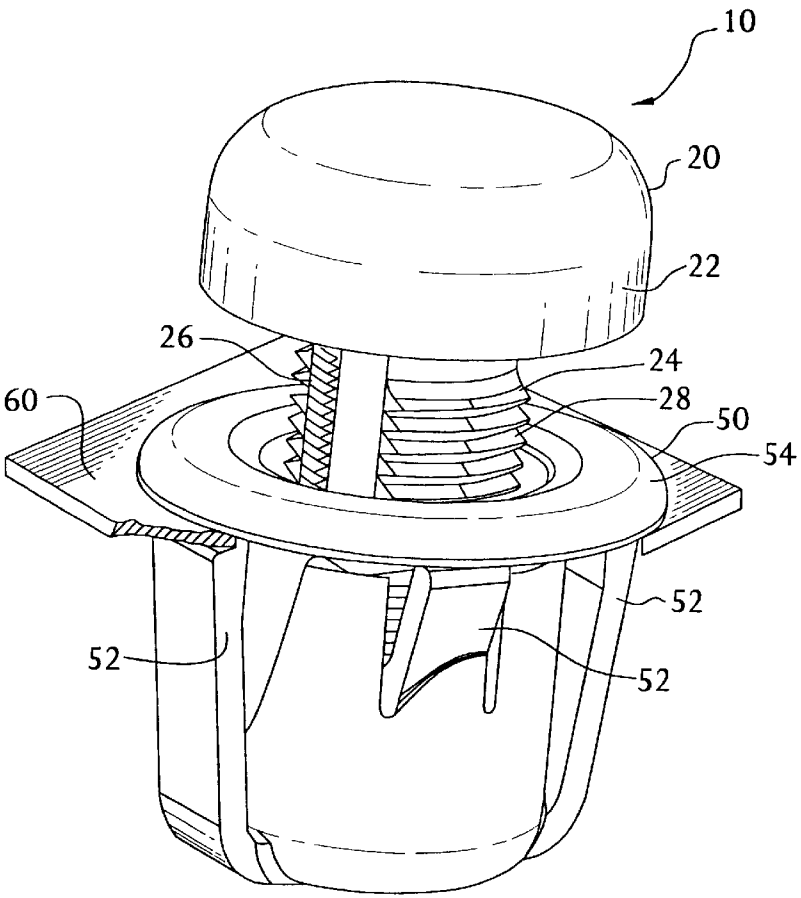
FIG. 2 is a perspective view of the automotive deck lid bumper of FIG. 1 as mounted on a panel, viewed from an angle looking down at the device, as assembled, with the stud in the initial snap in position in the receptacle.
Figure 1:
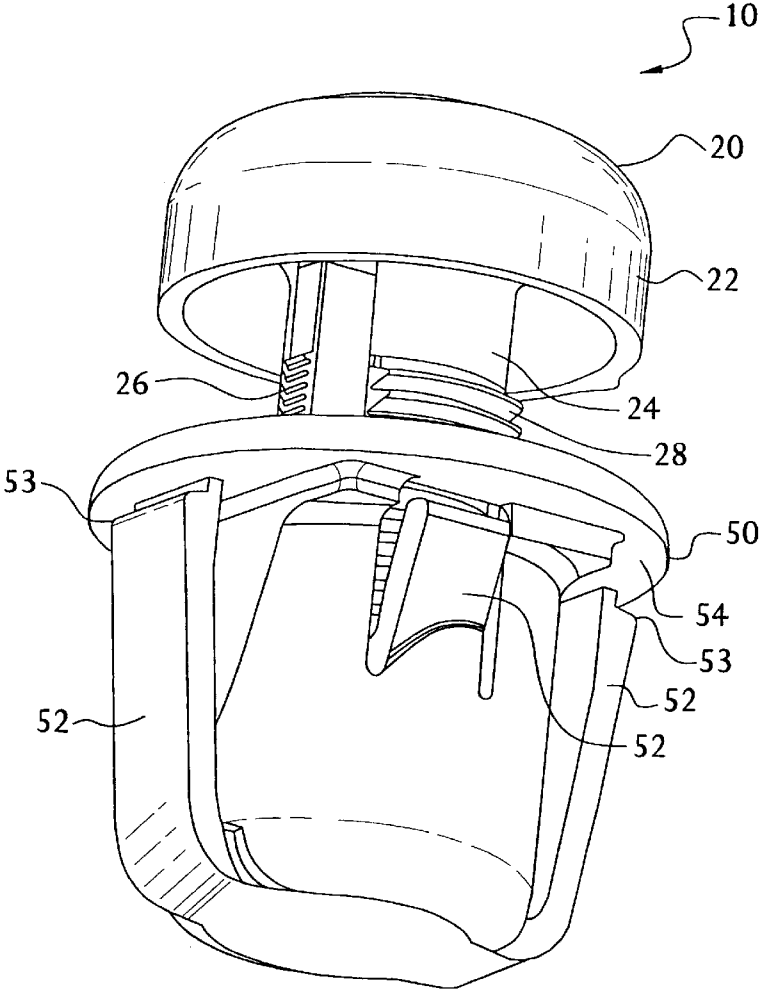
FIG. 1 is a perspective view of an automotive deck lid bumper in accordance with one embodiment of the present invention viewed from the bottom of the device, as assembled with a stud in an initial snap in position in the receptacle.

Referring now in detail to the drawings wherein like reference numbers indicate like elements throughout the several views, there is shown in FIGS. 1 and 2 a automotive deck lid bumper 10 in accordance with one preferred embodiment of the present invention. This first, preferred embodiment of the illustrative device is shown generally comprising a stud 20 and a receptacle 50.

The receptacle 50 contains a bumper retention means for retaining the deck lid bumper 10 onto an aperture in a frame or panel 60 of the automobile. This retention means may include one or more resilient snap arms 52 as shown in FIGS. 1 and 2 (two different styles shown) in combination with a receptacle flange 54 such that as the deck lid bumper 10 is pressed down into the aperture in the panel 60, the resilient snap arms 52 move inwardly until shoulders 53 are reached. When the panel 60 passes shoulder 53, the resilient snap arms 52 snap outwardly into position thereby holding the receptacle 50 in place.

The stud 20 has a head portion 22 and a shaft portion 24. The head portion 22 preferably has a generally rounded smooth upper surface which has an optional rubber cap or other relatively soft resilient material to aid in cushioning the impact of the deck lid. The shaft portion 24 of the stud 20 has two sets of ribs running axially down the outer surface of the shaft 24. First, a small set of ribs 26 on opposed sides of the shaft provides a ratcheting action (i.e. friction) against an opposed pair of receptacle ribs 54 to hold the stud 20 in place as the stud is axially lowered (or possibly raised) in the receptacle 50 during adjustment. Second, once the axial position of the stud 20 within the receptacle 50 is located, the stud 20 is rotated such that a large set of ribs 28 on the shaft portion 24 engages the receptacle ribs 54 to positively lock the stud 20 in position such that substantially no vertical movement of the stud 20 with respect to the receptacle 50 is provided. The manner in which this deck lid bumper 10 operates will be described below in greater detail.

Figure 7:
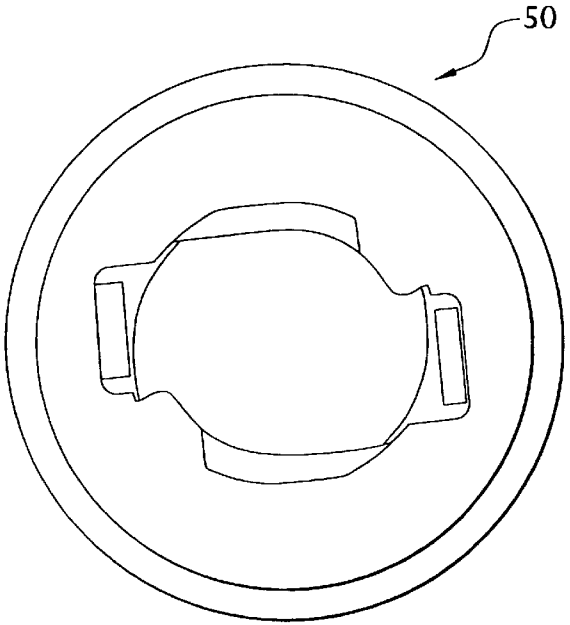
FIG. 7 is a top plan view of a receptacle of the automotive deck lid bumper of FIG. 1.
Figure 5:
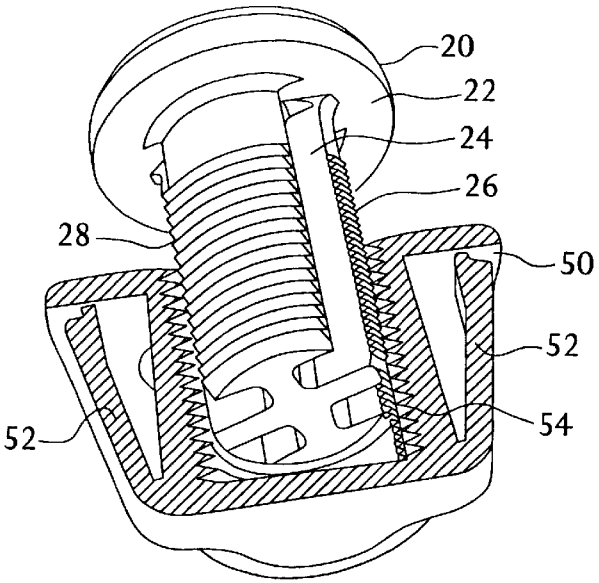
FIG. 5 is a perspective view, in partial section, looking upwardly, of the automotive deck lid bumper of FIG. 1, with the stud in the initial snap in position in the receptacle.
Figure 6:
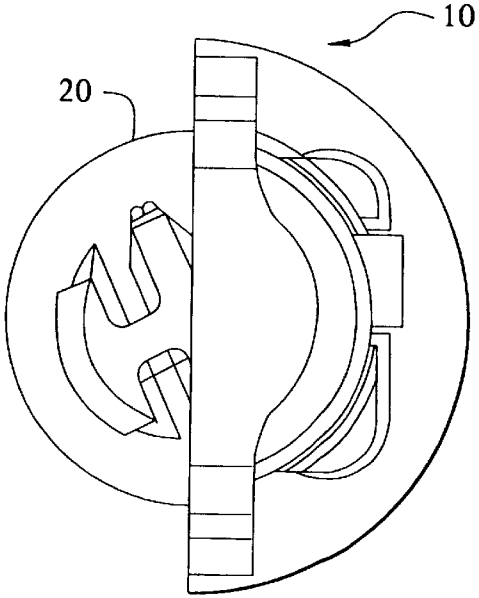
FIG. 6 is a bottom plan view of the automotive deck lid bumper of FIG. 1, partially cut away, with the stud in the temporary pre-set position.
Figure 10:
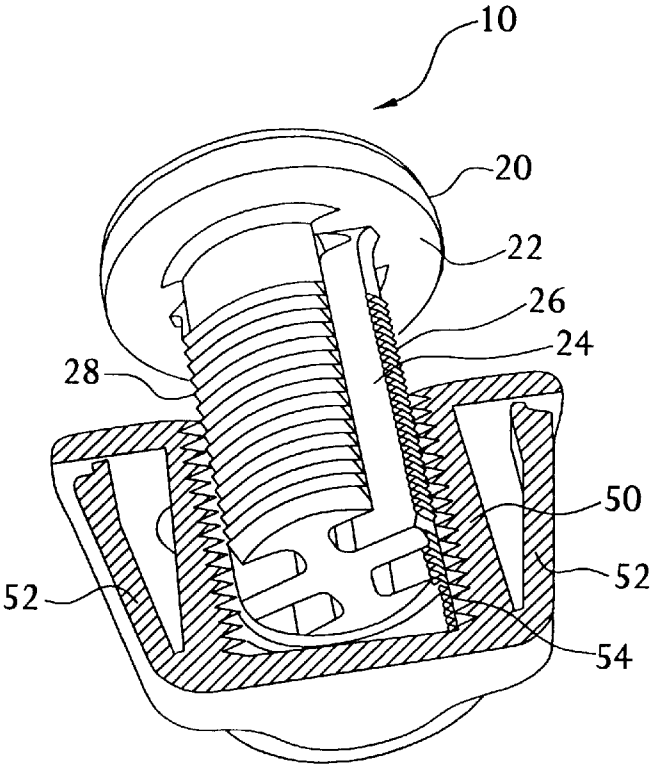
FIG. 10 is a partial section, perspective view of the automotive deck lid bumper of FIG. 1 with the stud in the receptacle in the initial snap in position.
Figure 11:
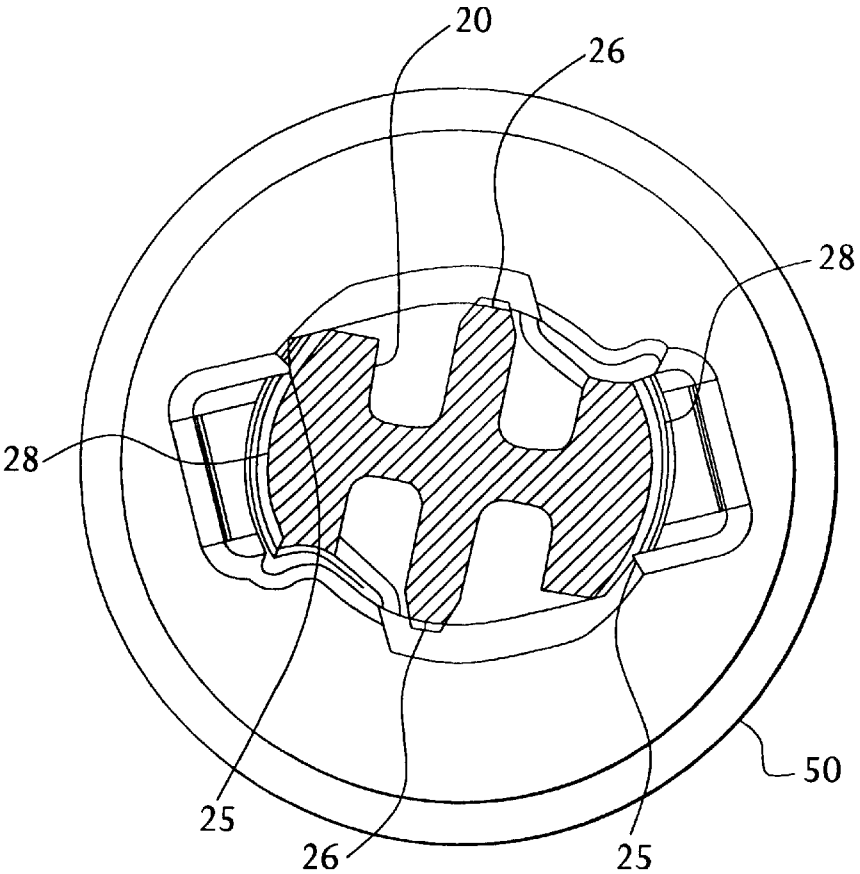
FIG. 11 is a partially cutaway top plan view of the automotive deck lid bumper of FIG. 1, with the stud in an initial snap in position in the receptacle.

FIGS. 1–3, 5, and 6 depict the deck lid bumper 10 with the stud 20 assembled with the receptacle 50 in the initial snap in position. Here, receptacle 50 of the deck lid bumper 10 is preferably attached to an automobile frame 60 (FIG. 2) and the stud 20 is in a fully extended position. The deck lid of the automobile is then lowered to the proper height to a position where the deck lid mates flush with surrounding body panels. This deck lid strikes the head portion 22 of the stud 20 causing the stud to lower into its proper vertical position within the receptacle 50. At this point, friction to hold the stud 20 in its proper vertical position is created by the ratcheting action of the small set of ribs 26 on the shaft portion of the stud 20. These ribs contact the significantly larger receptacle ribs 54, thus providing a designed in ratchet action providing desired amount of friction. That is, the ratcheting action provides very small incremental steps, for example, in 0.8 mm increments, by which the stud 20 may be lowered (or perhaps raised) into the receptacle 50. See FIG. 7 for top view of receptacle. The cross-sectional shape of the stud shaft portion 24 is elongated and mates with the receptacle orifice 56 such that the stud 20 must fit into the receptacle orifice in its initial position when the small set of ribs 26 mates with the receptacle ribs 54. This position can also be seen in FIGS. 10 and 11. FIG. 10 depicts this initial relationship of the stud 20 with respect to the receptacle 50 in a cut away view. FIG. 11 depicts a partially cutaway plan view of the deck lid bumper 10 where a portion of the small set of ribs 26 of the stud 20 makes contact with a portion of the receptacle ribs 54 such that sufficient ratcheting-type friction is provided to properly hold the stud 20 in place within the receptacle.

Figure 4:
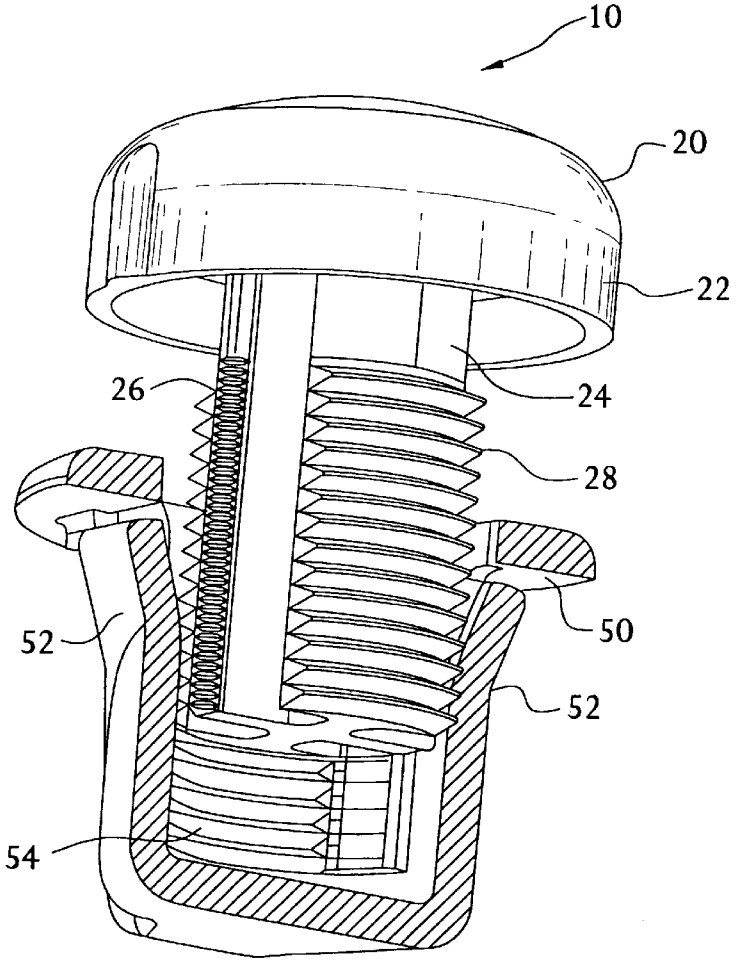
FIG. 4 is a partial section, perspective view of the automotive deck lid bumper of FIG. 1 with the stud in a locked position in the receptacle.
Figure 3:
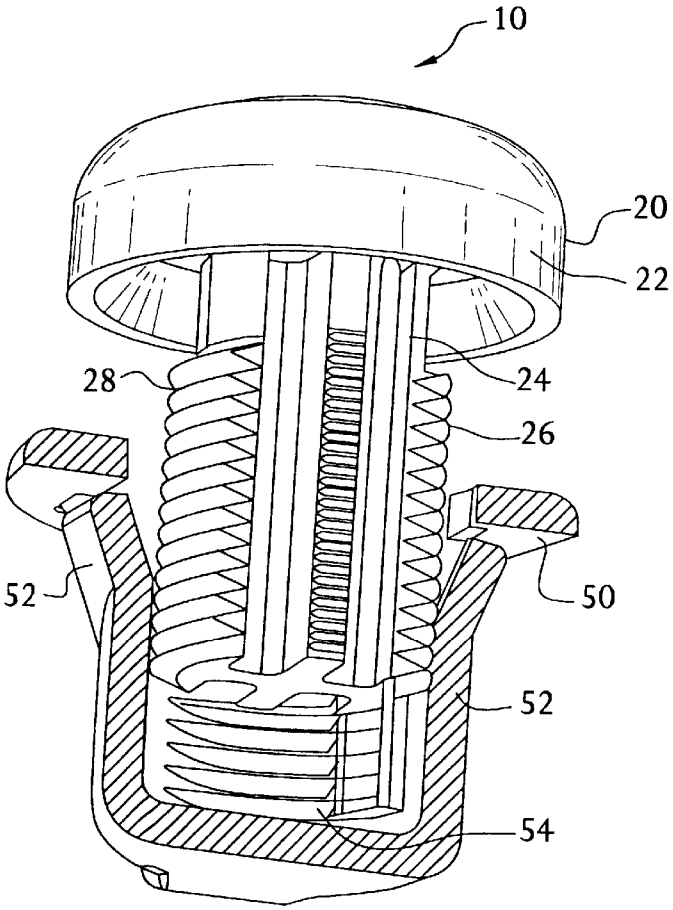
FIG. 3 is a partial section, perspective view of the automotive deck lid bumper of FIG. 1 with the stud in the initial snap in position in the receptacle.

The stud 20 is then rotated clockwise for preferably less than one-quarter turn (preferably approximately sixty-five degrees) with respect to the receptacle 50 to lock the stud 29 axially in place within the receptacle 50. By turning the stud 20 ninety degrees, the small set of ribs 26 moves clear of the receptacle ribs 54, however, the large set 28 of ribs now moves into position to securely mate with the receptacle ribs 54. See FIGS. 4, 8, and 9. The large set of ribs 28 is of substantially the same pitch and shape as the receptacle ribs 54 such that substantially no vertical movement of the stud 20 with respect to the receptacle 50 is possible.

Figure 9:
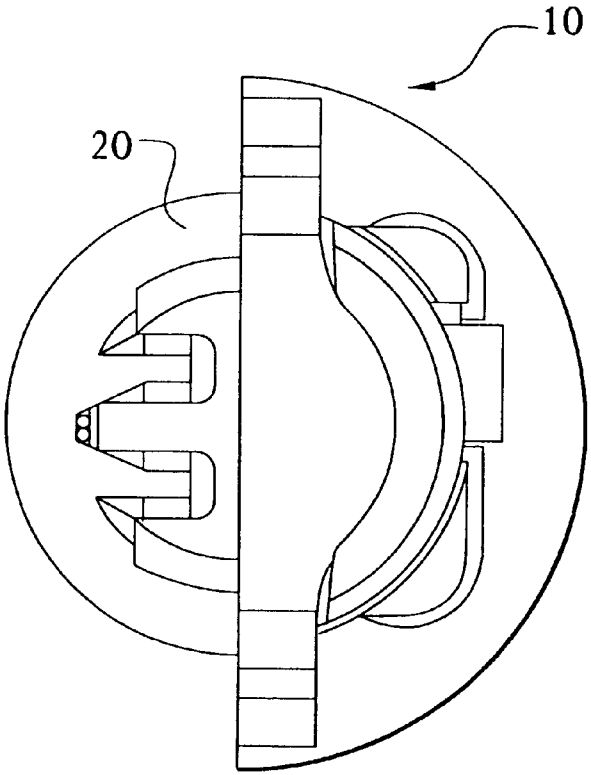
FIG. 9 is a top plan view of the automotive deck lid bumper of FIG. 1, partially cut away, with the stud in the permanent locked position.
Figure 8:
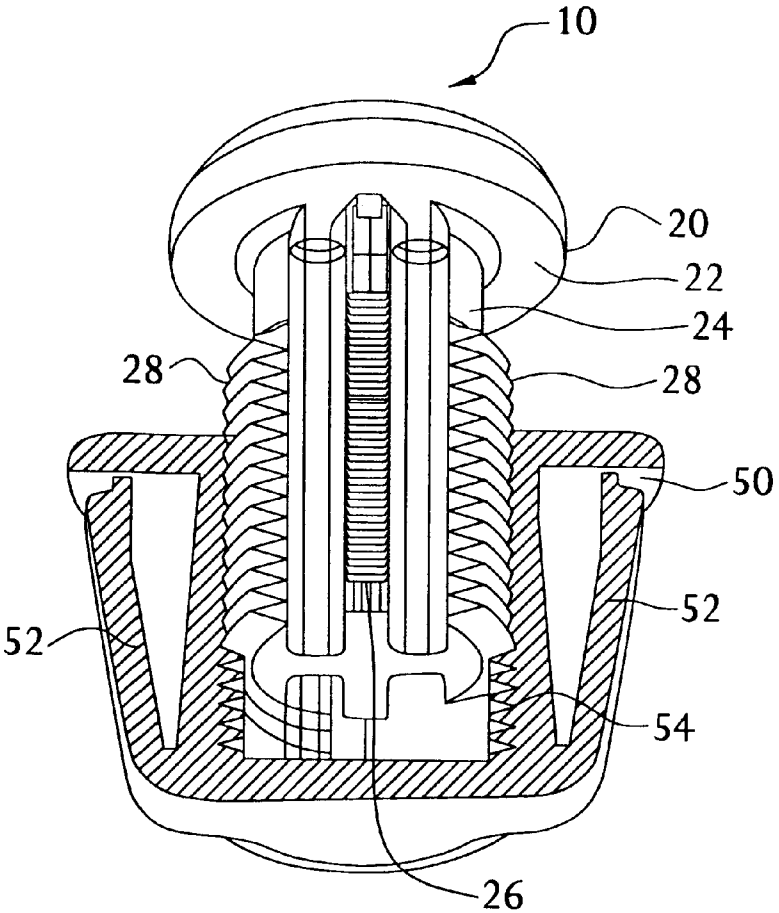
FIG. 8 is a perspective, partially cut away view of the automotive deck lid bumper of FIG. 1, with the stud in a permanent locked position in the receptacle.
Figure 12:
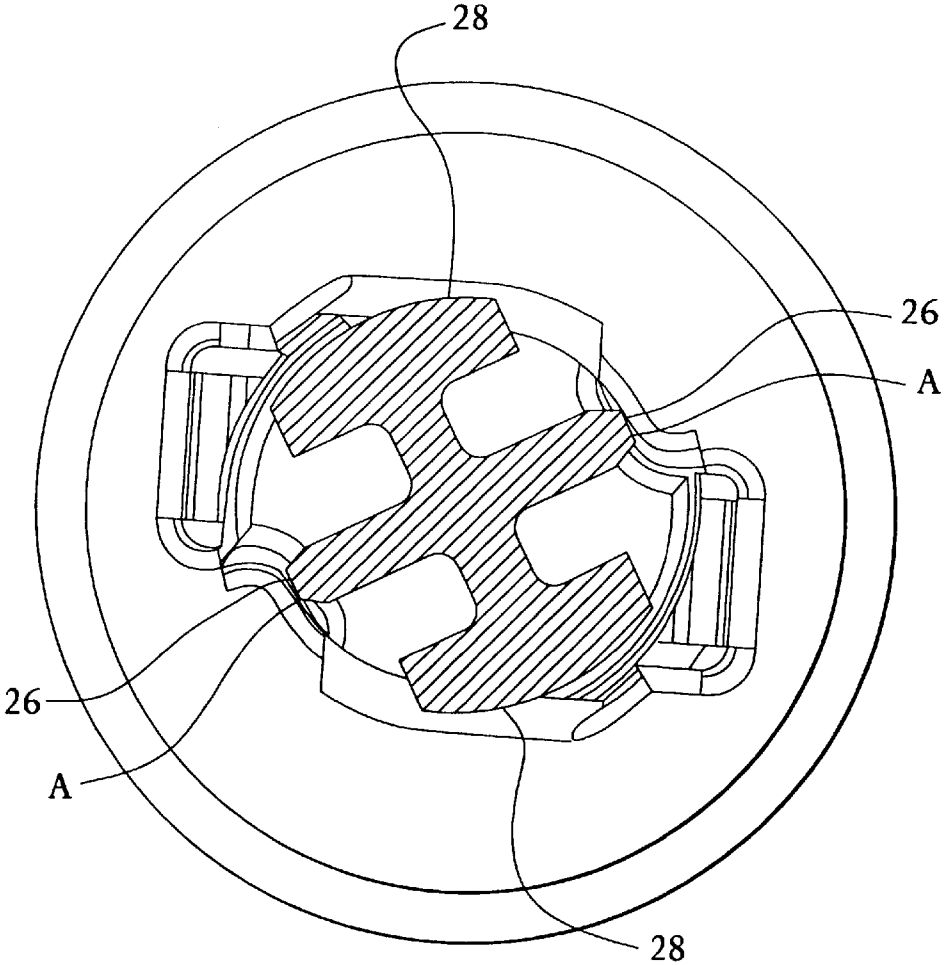
FIG. 12 is a partially cut away top plan view of the automotive deck lid bumper of FIG. 1, with the stud in the receptacle, partially rotated to approximately 35 degrees.
Figure 13:
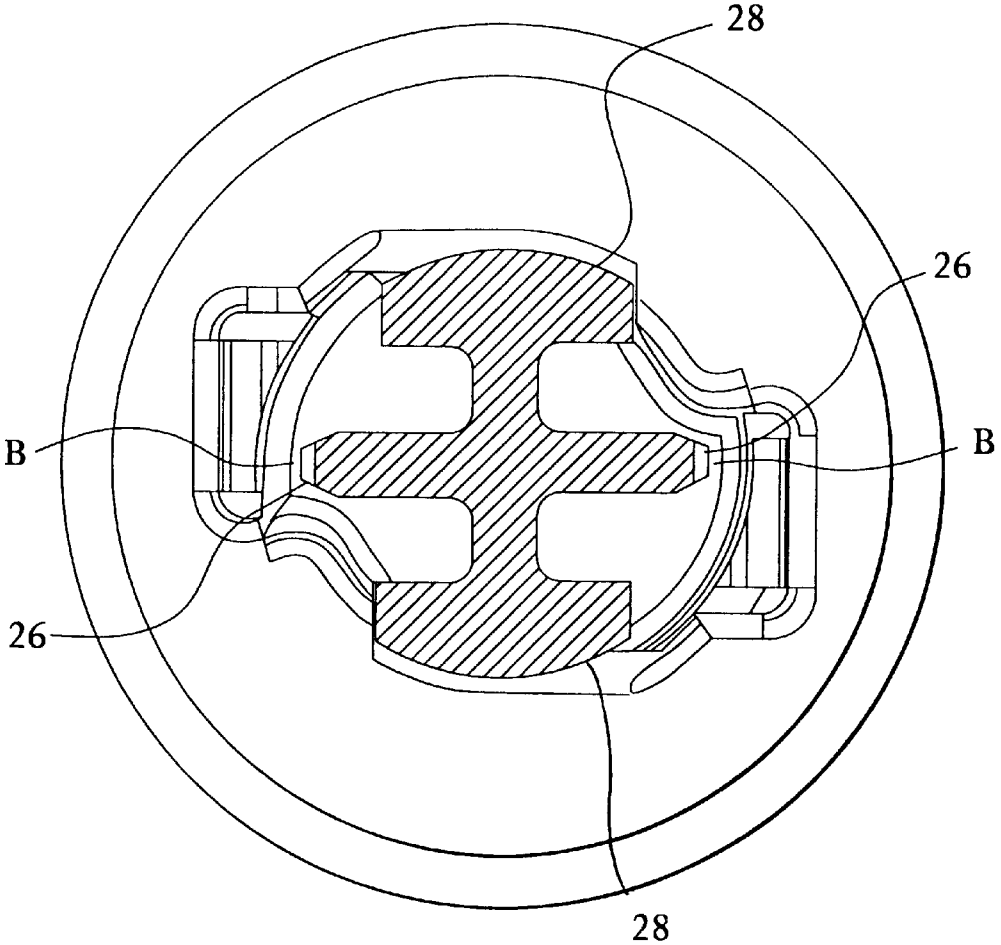
FIG. 13 is a top plan view of the automotive deck lid bumper of FIG. 1, with the stud in the receptacle rotated to its seated (locked) position at approximately 65 degrees.

Optionally, the connection between the stud 20 and the receptacle 50 contains a "click-in" or snap in feature which provides an audible indication and positive lock when the stud 20 is rotated into the final locked in position in the receptacle 50. As can be seen in FIGS. 8 and 9, when the stud is in the initial position prior to rotation, the small set of ribs 26 makes minimal contact with the receptacle ribs 54, merely providing a ratcheting-type friction as described in detail above. When the stud 20 is rotated to, for example approximately thirty degrees, as depicted in FIG. 12, the small set of ribs 26 have a clear interference with a smooth section A on the inner surface of the receptacle 50. Therefore, as the small ribs pass point A (FIG. 12) an increase in torque on the stud 20 is required. Finally, the small ribs 26 pass to an area on the inner surface of the receptacle that provides for clearance (point B of FIG. 13) of those ribs 26. See FIG. 13. The transition from point A to point B of the stud creates an audible "click" indicating that the stud 20 is properly locked into position in the receptacle. The stud 20 can be unlocked using the reverse of the above. That is, the small ribs pass from point B, through point A, until the small ribs alone make contact with the large set of ribs 28.

This embodiment depicts two sets of two ribs using a quarter turn to lock. It is also anticipated that one set of each type of ribs using, for example, a one hundred eighty degree lock, or three or more set of ribs using less rotation to lock also operates properly and is within the scope of this invention. However, to simplify use, rotating by less than one full revolution is preferred.

To prevent the stud 20 from cocking with respect to the receptacle 50 when the stud 20 is in the initial snap in position, two projections 25 may be added to the receptacle. See FIG. 11.

Figure 15:
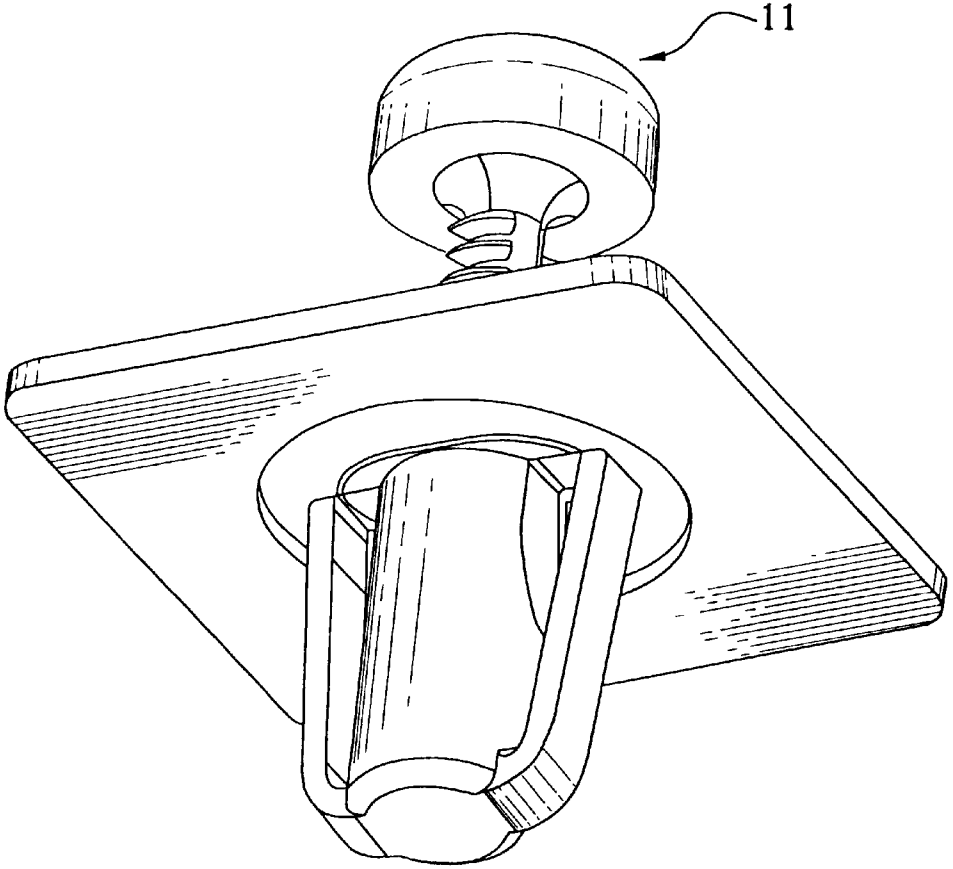
FIG. 15 is a perspective view of the automotive deck lid bumper of FIG. 14, as mounted on a panel, depicting the bottom of the bumper with the stud in the initial snap in position.
Figure 14:
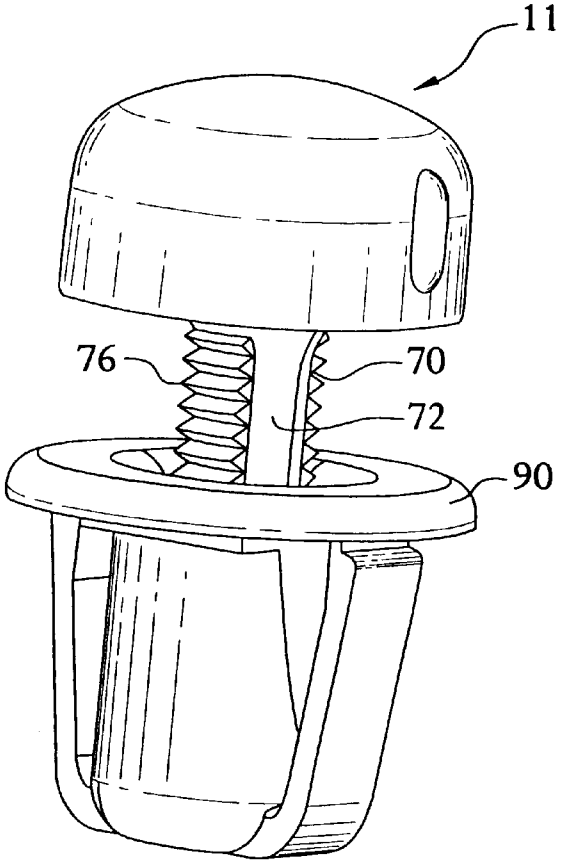
FIG. 14 is a perspective view of a second embodiment of an automotive deck lid bumper in the initial snap in position.
Figure 22:
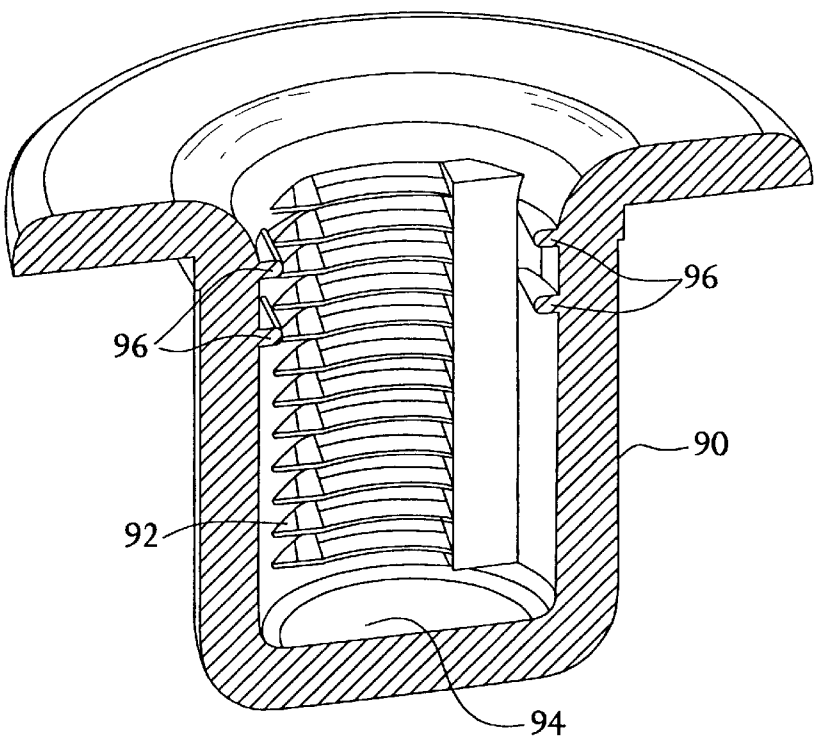
FIG. 22 is a cross-sectional perspective view of the receptacle of FIG. 21.
Figure 21:
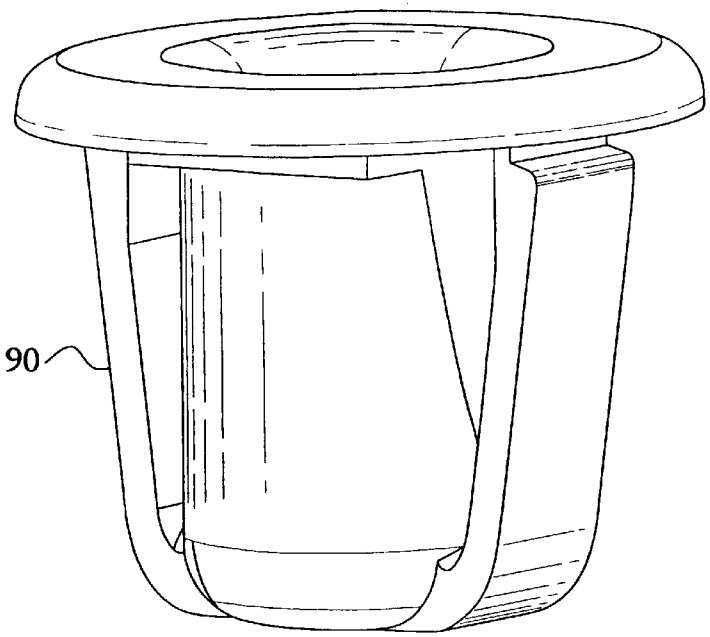
FIG. 21 is a receptacle for the automotive deck lid bumper of FIG. 14.
Figure 26:
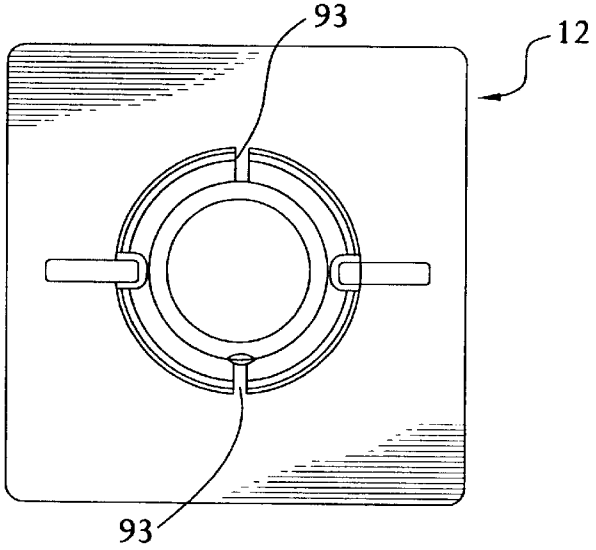
FIG. 26 is atop plan view of the automotive deck lid bumper of FIG. 23 with the stud in the initial snap in position.
Figure 25:
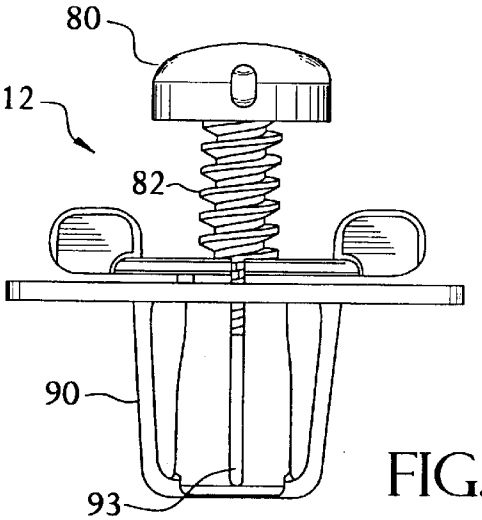
FIG. 25 is a side elevational view of the automotive deck lid bumper of FIG. 23 with the stud in the initial snap in position.

FIGS. 14 and 15 depict a second embodiment 11 of an automotive deck lid bumper. This embodiment 11 also contains the two primary elements of the first embodiment: a stud 70 and a receptacle 90. This embodiment is a somewhat more simple representation of the present invention in which only one set of ribs 76 is used on the shaft 72 of the stud 70 rather than a large set and a small set as in the first embodiment. Here, adequate ratcheting-type friction is provided using a slight interference fit created by two pairs of ribs extending out from the aperture 94 of the receptacle 90 which mate with the ribs on the stud. See FIG. 22. Again, here, the stud 70 is located to the proper axial position within the receptacle 90 and is held in place by ratchet-type friction. The stud 70 is then rotated 90 degrees to lock the stud ribs 76 to the receptacle ribs 92 in a similar manner to that as described for the first embodiment. FIG. 21 depicts the outside of the receptacle 90 for this second embodiment.

Figure 17:
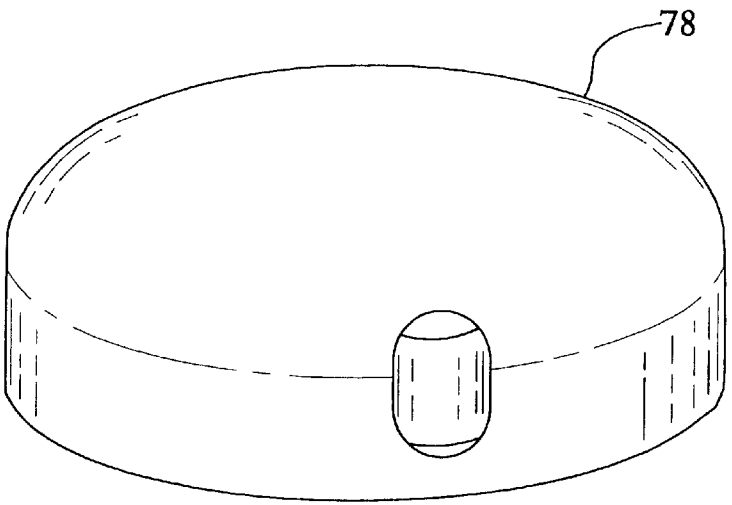
FIG. 17 is a perspective view of the rubber stud of FIG. 16 showing the top of the cap.
Figure 16:
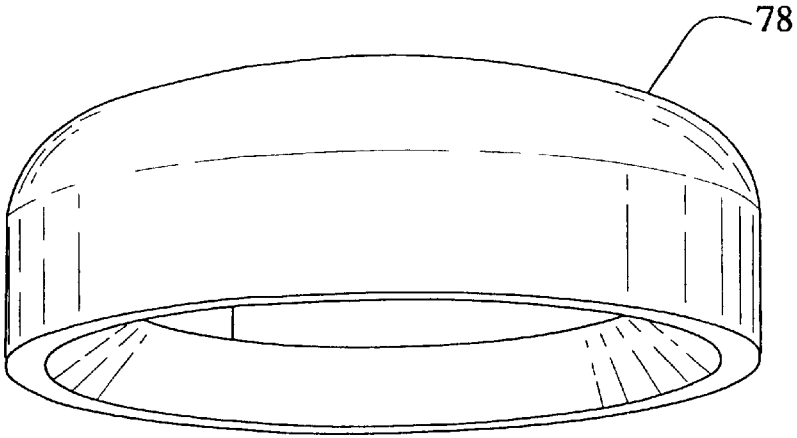
FIG. 16 is a perspective view of a rubber stud cap for use on the automotive deck lid bumper of FIG. 15, showing the bottom of the cap.
Figure 20:
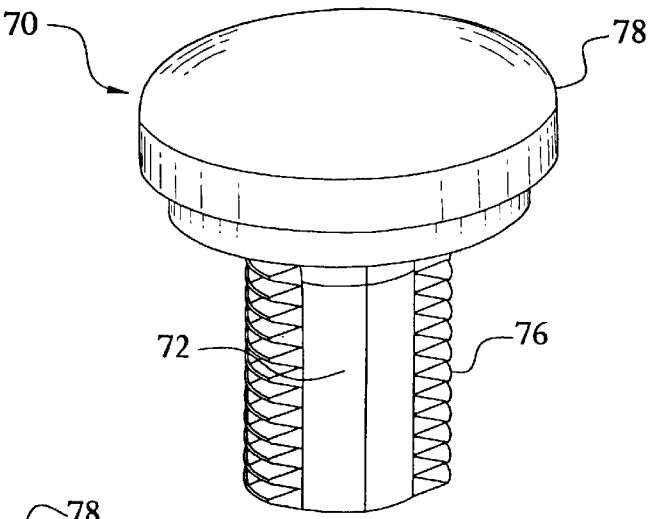
FIG. 20 is a perspective view of the stud and rubber stud cap of FIG. 18 showing the top of the assembly.
Figure 19:
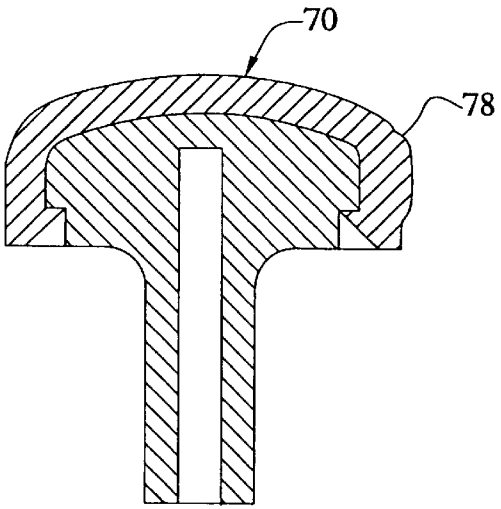
FIG. 19 is a cross-sectional view of the stud and stud cap of FIG. 18.
Figure 18:
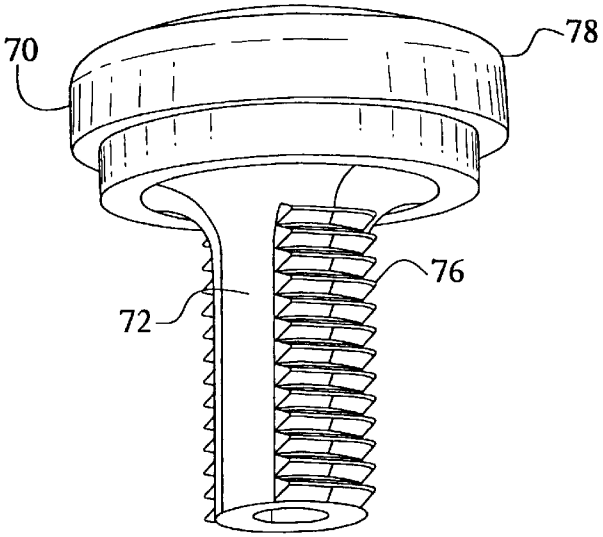
FIG. 18 is a perspective view of the stud as used on the automotive deck lid bumper of FIG. 15 with the rubber stud cap also shown, showing the bottom of the assembly.

FIGS. 16 and 17 depict a separate head portion 78 of the stud 70 which may optionally be used on any embodiment herein, for example, to provide a softer rubber bumper head and harder, for example reinforced molded plastic stud and receptacle. FIGS. 18–20 depict various views of the stud 70 with optional separate head portion 78 shown. FIG. 21 depicts the receptacle 90 alone.

Figure 23:
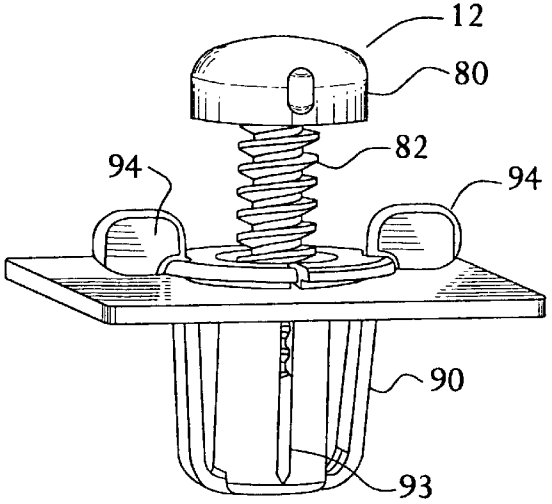
FIG. 23 is a perspective view of a third embodiment of an automotive deck lid bumper of the present invention with the stud in the initial snap in position.
Figure 24:
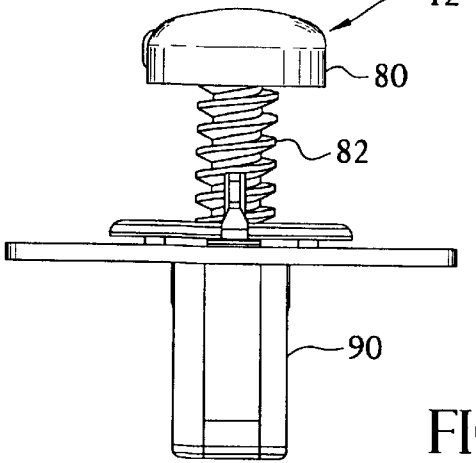
FIG. 24 is a front elevational view of the automotive deck lid bumper of FIG. 23 with the stud in the initial snap in position.
Figure 30:
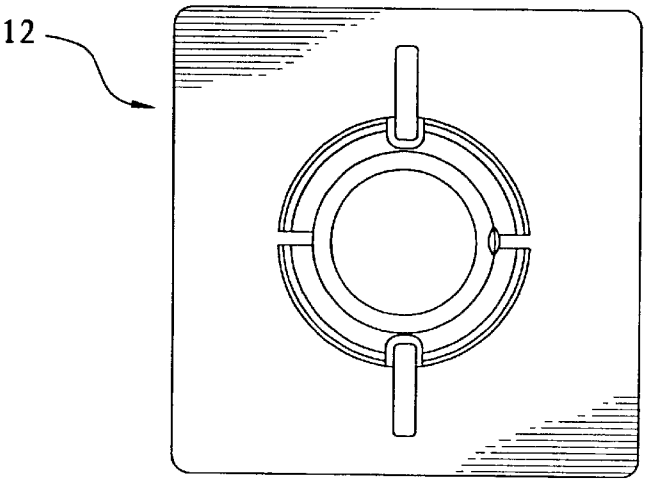
FIG. 30 is a top plan view of the automotive deck lid bumper of FIG. 23 with the stud in the locked in position.
Figure 29:
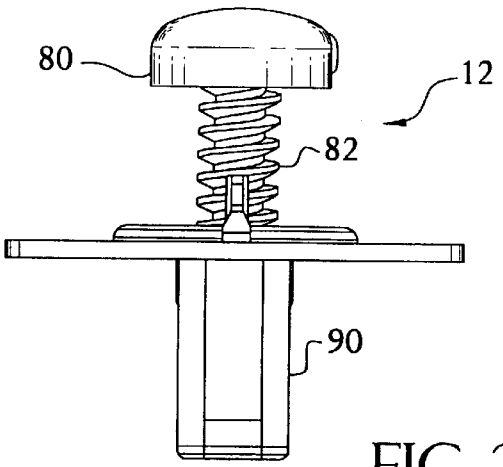
FIG. 29 is a side elevational view of the automotive deck lid bumper of FIG. 23 with the stud in the locked in position.
Figure 27:
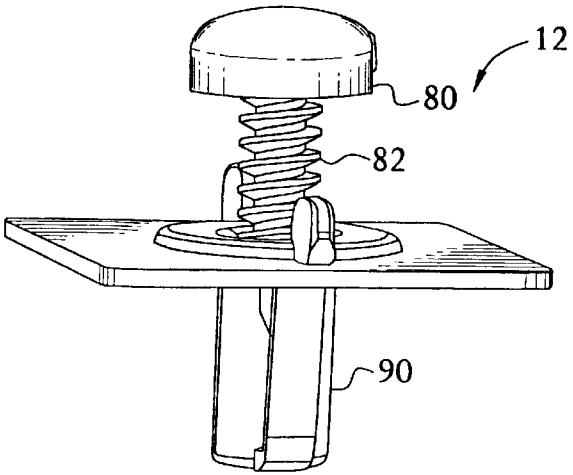
FIG. 27 is a perspective view the automotive deck lid bumper of FIG. 23 with the stud in the locked in position.
Figure 28:
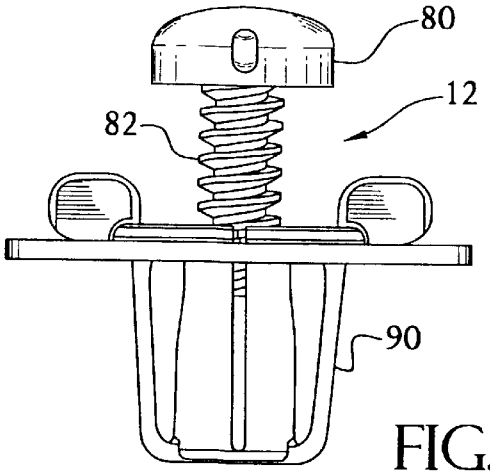
FIG. 28 is a front elevational view of the automotive deck lid bumper of FIG. 23 with the stud in the locked in position.
Figure 31:
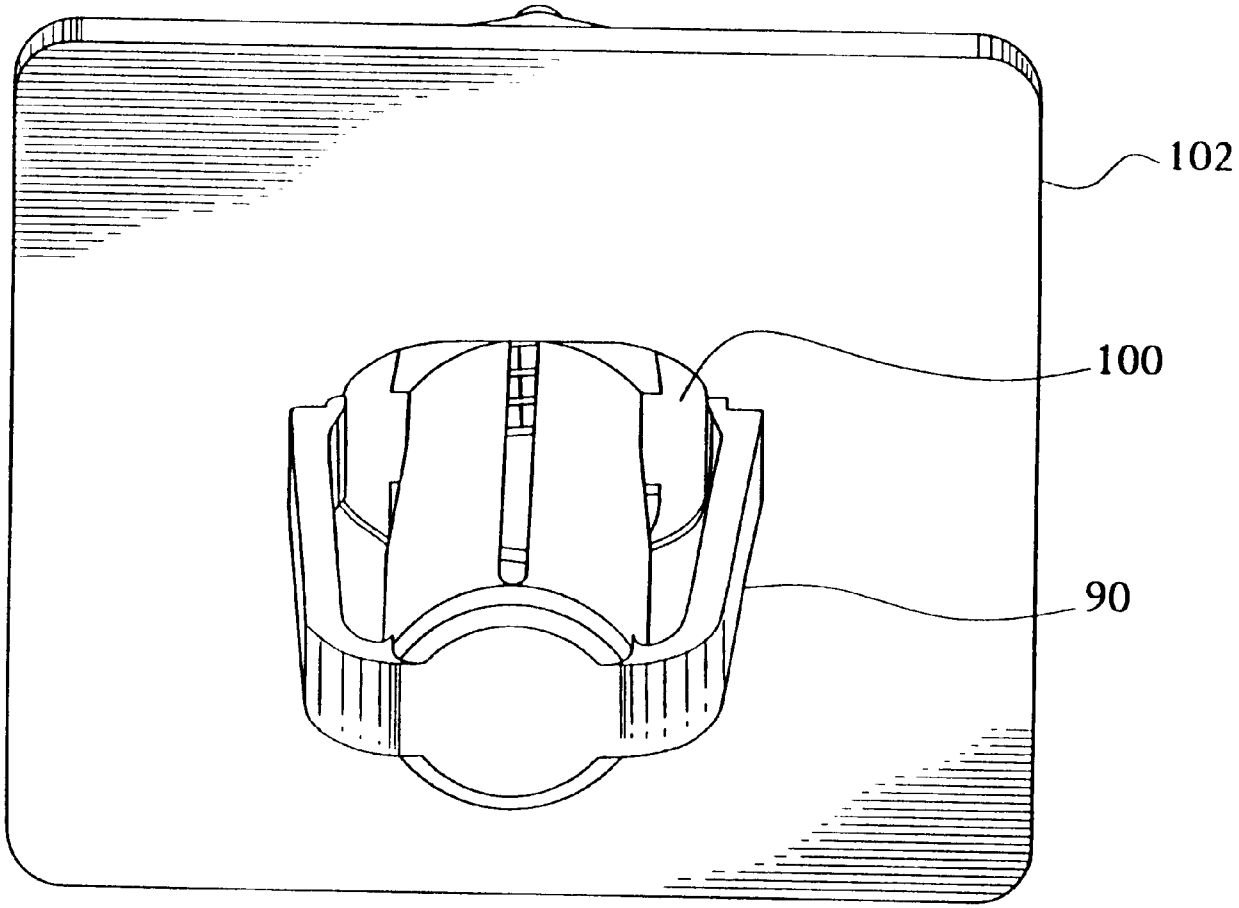
FIG. 31 is a bottom perspective view of the automotive deck lid bumper of FIG. 23 with the stud in the initial snapped in position.
Figure 32:
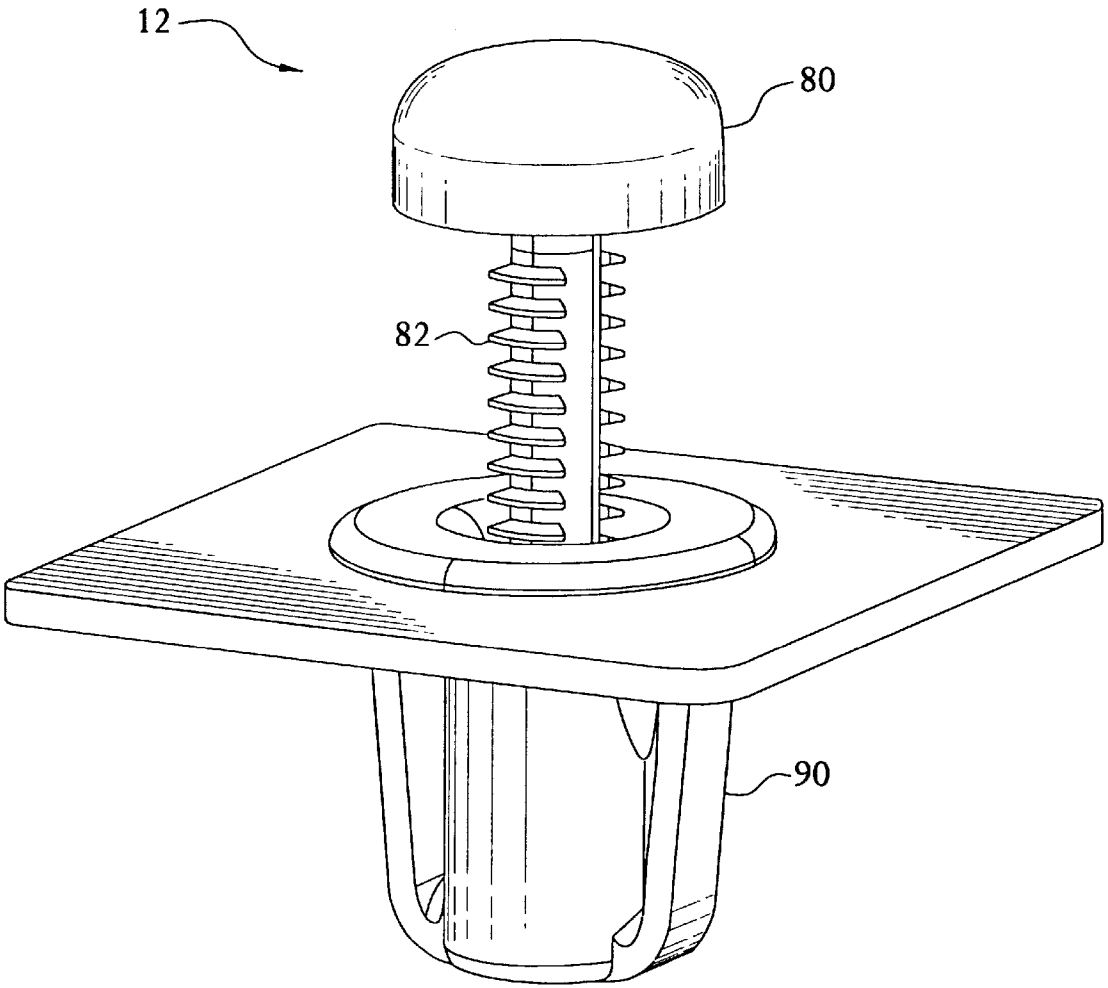
FIG. 32 is a top perspective view of the automotive deck lid bumper of FIG. 23 with the stud in the initial snapped in position.

Finally, FIGS. 23–32 depict a third embodiment 12 for an automotive deck lid bumper of the present design. Here, FIGS. 23–26 and 32 depict the stud 80 in the initial snap in position. Here, similar to the above embodiments, although threads 82 are used, the stud 80 is held in place by friction between the threads 82 and internal threads (not shown) in the receptacle 90. That is, the stud 80 can move axially downward in the receptacle 90 without turning. Here, again, a ratchet-type friction is created. The receptacle 90 is constructed from a resilient elastic material such as an appropriate polymer that allows the material to deflect slightly. As can be seen in FIG. 23, open slots 93 are formed in the receptacle 90. The locking aspect of this embodiment uses a rectangular hole 100 in the frame or panel 102 to which this bumper 12 is mounted, as seen in FIG. 31. When the bumper 12 is initially snapped into place in the panel 100, the long sides of the rectangular cutout are located adjacent the open slots 93 of the receptacle. The stud 80 is locked into place by rotating the entire assembly 12 ninety degrees using wings 94 on receptacle 90. This causes the open slots 93 to move to the short side of the rectangular hole 100 which causes the slots 93 to crimp tight against the threads 82 of the studs, thus locking the stud 80 axially in place with respect to the receptacle 90. This locked position is clearly depicted in FIGS. 27–30.

All of the above embodiments may use a separate rubber cap, as illustrated in FIGS. 17–19 for the second embodiment, if desired.

Although the description above is directed to an automotive deck lid bumper, it is anticipated that the present invention can easily be adopted for use anywhere doors or panels of any type mate with adjacent panels where construction tolerances or other factors cause the door to improperly mate with its adjacent panels.

It is also anticipated that all embodiments of the above invention can be constructed using many types of plastics. For example, the receptacle can be molded from Acetal, while the stud can be molded from glass filled nylon, with, for example, a rubber cap. It is anticipated that numerous materials would be suitable for the present application, provided that provide a compatible relationship that provides suitable resilience for the applications as indicated herein. The stud and receptacles as described above can each be molded as a single integral piece.

For the embodiments described in detail below, the deck lid bumper may optionally be installed in either a locked position or an adjustable position.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

We claim:

1. A deck bumper comprising:

(a) a stud, having a head portion and a shaft portion, said head portion adapted to bump against said deck upon closure of the deck against the bumper;

(b) a receptacle adapted to receive said shaft portion of said stud, said receptacle having means to secure said receptacle in a frame;

(c) said shaft portion of said stud having a plurality of radial grooves on the outer portion of the shaft that resiliently mate with at least one tooth on an inner surface of said receptacle to provide ratcheting-type friction between said shaft portion of said stud and said receptacle sufficient to support said stud in substantially a desired position within said receptacle; and (d) locking means to lock said shaft portion of said stud into said receptacle by axially rotating said head portion of said stud with respect to said receptacle less than one full revolution.

2. The deck lid bumper of claim 1, wherein the locking means snaps in place when the stud is fully rotated into a locked position.

3. The deck lid bumper of claim 1, wherein the locking means audibly indicates when the stud is fully rotated into a locked position.

4. The deck lid bumper of claim 1, wherein the head portion includes an upper surface, said upper surface including resilient material.

5. A deck bumper comprising:

(a) a stud, having a head portion and a shaft portion, said head portion adapted to bump against said deck upon closure of the deck against the bumper;

(b) a receptacle adapted to receive said shaft portion of said stud, said receptacle having means to secure said receptacle in a frame; and (c) said shaft portion of said stud having a first set of small radial grooves and a second set of large radial grooves located axially on an outer perimeter of said shaft, said first set comprising a plurality of small radial grooves on the outer portion of the shaft adapted to resiliently mate with at least one tooth on an inner surface of said receptacle to provide ratcheting-type friction between said shaft portion of said stud and said receptacle sufficient to support said stud in substantially a desired position within said receptacle, said second set of large radial grooves comprising teeth adapted to securely mate with said at least one tooth;

whereby a frictional position and a locking position are provided, said stud in said frictional position when said first set of radial teeth engages said at least one tooth on the inner surface of said receptacle and said stud in said locking position when said stud is axially rotated with respect to said receptacle such that said second set of radial teeth engages said at least one tooth on the inner surface of said receptacle.

6. The deck lid bumper of claim 5, wherein the locking means snaps in place when the stud is fully rotated into a locked position.

7. The deck lid bumper of claim 5, wherein the locking means audibly indicates when the stud is fully rotated into a locked position.

8. The deck lid bumper of claim 5, wherein the head portion includes an upper surface, said upper surface including resilient material.

9. A deck bumper comprising:

(a) a stud, having a head portion and a shaft portion, said head portion adapted to bump against said deck upon closure of the deck against the bumper;

(b) a receptacle adapted to receive said shaft portion of said stud; said receptacle having means to secure said receptacle in a frame; and (c) said shaft portion of said stud having a first set of small radial grooves and a second set of large radial grooves, said first set comprising a plurality of small radial grooves on the outer portion of the shaft adapted to resiliently mate with a at least one tooth of a plurality of radial teeth on an inner surface of said receptacle to provide ratcheting-type friction between said shaft portion of said stud and said receptacle sufficient to support said stud in substantially a desired position within said receptacle, said second set of large radial grooves comprising teeth adapted to securely mate with said plurality of teeth;

whereby a frictional position and a locking position are provided, said stud in said frictional position when said first set of radial teeth engages said at least one tooth of said plurality of teeth on the inner surface of said receptacle and said stud in said locking position when said stud is axially rotated with respect to said receptacle such that said second set of radial teeth engages said at least one tooth on the inner surface of said receptacle.

10. The deck lid bumper of claim 9, wherein the locking means snaps in place when the stud is fully rotated into a locked position.

11. The deck lid bumper of claim 9, wherein the locking means audibly indicates when the stud is fully rotated into a locked position.

12. The deck lid bumper of claim 9, wherein the head portion includes an upper surface, said upper surface including resilient material.

* * * * *